United States Patent [19]

Amano et al.

[11] 4,064,727

[45] Dec. 27, 1977

[54] ROLL FORMING MACHINE

[76] Inventors: Tadashi Amano, Yamazaki Danchi 2-4-501, 2200, Yamazaki-cho, Machida, Tokyo; Susumu Kawano, 28-28 Nurumizu, Atsugi, Kanagawa; Kenji Mano, 567-2, Tanaka, Isehara, Kanagawa; Takaji Irisawa, 653-1, Higashitahara, Hatano, Kanagawa, all of Japan

[21] Appl. No.: 680,379

[22] Filed: Apr. 26, 1976

[30] Foreign Application Priority Data

Apr. 25, 1975 Japan ..... 50-55800[U]

[51] Int. Cl.[2] ..... B21D 5/14

[52] U.S. Cl. ..... 72/179

[58] Field of Search ..... 72/179–181, 72/178, 176

[56] References Cited

U.S. PATENT DOCUMENTS

| | | | |
|---|---|---|---|
| 1,649,613 | 11/1927 | Olson | 72/179 X |
| 1,673,787 | 6/1928 | Frahm et al. | 72/178 |
| 2,294,324 | 8/1942 | Wilkens et al. | 72/181 X |
| 3,462,989 | 8/1969 | Fischer, Jr. | 72/178 |
| 3,914,971 | 10/1975 | Colbath | 72/178 |

*Primary Examiner*—Milton S. Mehr

*Attorney, Agent, or Firm*—Wigman & Cohen

[57] ABSTRACT

This disclosure relates to a roll forming machine having a plurality of sequentially-arranged forming units adapted to progressively bend edges of metal sheet into a given shape. The forming units include upper and lower rollers between which the metal sheet is fed and having axes of rotation inclined to one another. Each of the lower rollers includes a bending portion and a holding portion defining a predetermined angle therebetween. The upper roller has two frusto-conical peripheries disposed in confronting relation to the working surfaces of the lower roller and spaced therefrom by a distance corresponding to the thickness of the sheet metal. In order to accommodate sheet metals of different thicknesses, the spacing between the upper and lower rollers may be varied by mounting the upper roller on a swingable mounting means whereby the upper roller is swung along a relatively short arc which approximates a linear path bisecting the angle defined by the working surfaces of the lower roller. The rollers are designed to be "square" for a metal sheet having a thickness at the midpoint of a predetermined range of thicknesses, and there is an approximation of squareness at the end points of the range.

7 Claims, 4 Drawing Figures

ROLL FORMING MACHINE

BACKGROUND OF THE INVENTION

1. Field of the Invention

The present invention relates generally to roll forming machines having rolls for working sheet metals, and more particularly to that type of roll forming machines which serve to form opposite edges of sheet metals into bent sectional shapes.

2. Description of the Prior Art

A typical roll forming machine for processing sheet metals into bent sectional shapes is provided with a plurality of horizontally mounted pairs of vertically aligned upper and lower rolls, and the sheet metals to be worked are fed between the upper and lower rolls of each pair with rotation thereof. Of course, the upper and lower rolls of each pair are designed to serve as dies to produce bends in the sheet metals in cooperation with each other. Also, the pairs of the upper and lower rolls are so designed that the sheet metals are slightly worked by the initial pair of upper and lower rolls and additionally bent stage by stage by the succeeding rolls and finally formed to desired sectional shapes by the last pair of rolls.

In conventional forming machines, the shafts of the upper and lower rolls have been disposed in parallel with each other, and such construction is very complicated.

Accordingly, in the conventional roll forming machines, it has been very difficult and time-consuming to adjust the clearance between the upper and lower rolls depending upon the thicknesses of sheet metals to be worked.

Also, another disadvantage with the conventional forming machines has been the fact that the bends to be made on the sheet metals will be hindered by the upper roll and their shafts which are disposed in parallel with the axes of the lower rolls.

Still another disadvantage with the prior art forming machines has been that the rolls can be only used to form sheet metals to a given sectional shape and accordingly it has been necessary to change the rolls when it is desired to form different sectional shapes on sheet metals.

Also, the conventional roll forming machines have been costly because of complicated construction.

SUMMARY OF THE INVENTION

It is an object of the present invention to provide a roll forming machine in which the clearance between the upper and lower rolls can be easily adjusted depending upon the thicknesses of sheet metals to be processed.

It is another object of the present invention to provide a roll forming machine which can produce relatively large bends on sheet metals while having a relatively small construction.

It is a further object of the present invention to provide a roll forming machine in which the rolls can be used to perform a relatively wide range of forming operations.

It is a still further object of the present invention to provide a roll forming machine which is of a simple construction and economical.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Figure 1:
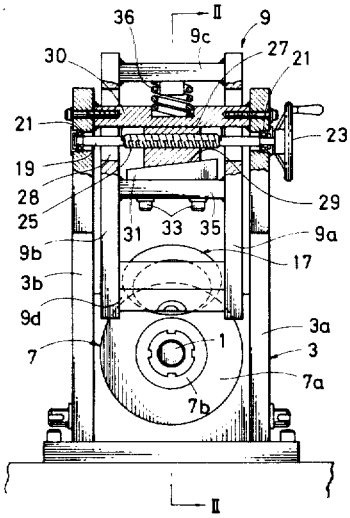
FIG. 1 is a front view of a portion of a roll forming machine according to the present invention.

It is initially to be noted that only a portion of the roll forming machine according to the present invention is shown in the drawings. Although the roll forming machine according to the present invention is so designed that sheet metals to be worked are gradually processed stage by stage by a plurality of forming stations each comprising two forming units, the drawings show only one of the last forming units of the last forming station where the sheet metals are finally formed to desired sectional shapes and therefore edges of the sheet metals are bent at right angles. Although only one unit that is the forming unit is shown in FIG. 2 for instance, another similar unit is in fact symmetrically placed on the right of the unit shown in FIG. 2, and also such pairs of symmetrically disposed forming units are successively mounted like two rows of trees edging a street.

The two symmetrically disposed forming units may be of all the same construction. Also, all the forming units are basically similar in construction, but it will be understood that a forming unit of one forming station is different from those of other stations in angle to which sheet metals are to be bent.

Figure 2:
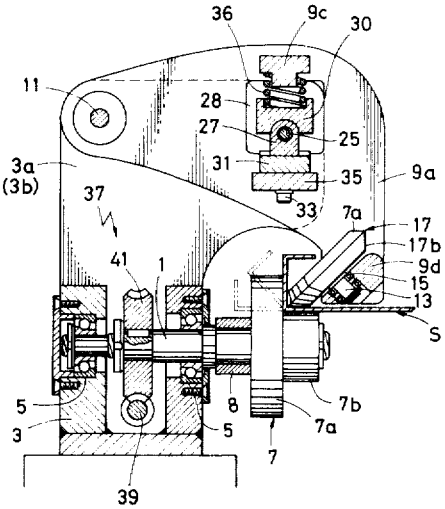
FIG. 2 is a sectional view taken along the line II—II of FIG. 1.
Figure 3:
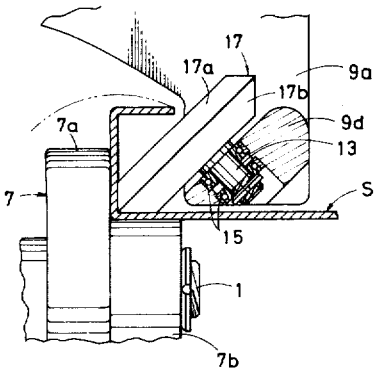
FIGS. 3 and 4 are enlarged views of important portions of FIGS. 2 and 1, respectively.
Figure 4:
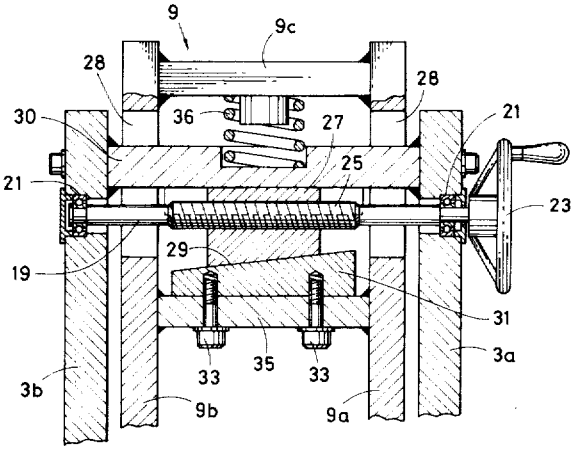

Referring now particularly to FIG. 2, a lower roll shaft 1 is rotatably supported by a frame 3 by means of bearings 5, 5, and a lower roll 7 having a bending portion *7a* and a holding portion *7b* is secured to an end of the shaft 1 together with a collar 8. The holding portion *7b* of the lower roll 7 is cylindrical and is horizontally disposed in all forming units, but the bending portion *7a* is formed at a particular angle to the peripheral surface of the holding portion *7b* depending upon angles to which the edges of sheet metals are to be bent. It will be seen that the bending portion *7a* shown in FIG. 2 is formed at a right angle to the peripheral surface of the holding portion *7b* so as to bend the edge of the sheet metal S to perpendicular position with respect to the plane of the sheet metal S. As seen hereinafter, the bending portion *7a* acts to bend the edge of the sheet metal S, while the holding portion *7b* holds horizontally the sheet metal S being bent. Also, it will be understood that the sheet metal S is bent to an angle which is formed by the bending portion *7a* and the holding portion *7b*.

A swing member 9 is swingably pivoted to a horizontal shaft 11 spanned between the top ends of side walls *3a* and *3b* of the frame 3. The swing member 9 comprises two parallel L-shaped arms *9a* and *9b* which are fixedly connected with each other by horizontal upper and lower beams *9c* and *9d*. An upper roll shaft 13 is rotatably supported by means of bearings 15, 15 on the horizontal beam *9d* secured at the free end of the swing member 9 and fixedly carries at its inner end an upper roll 17.

The upper roll 17 is a disk having two frusto-conical peripheries *17a* and *17b* and is so designed that the frusto-conical peripheries 17*a* and 17*b* at their lowermost position will face in parallel with the bending portion 7*a* and the holding portion 7*b* of the lower roll 7, respectively, at their uppermost rotational position. The frusto-conical periphery 17*a* of the upper roll 17 acts as a bending portion to bend the sheet metal S in cooperation with the bending portion 7*a* of the lower roll 7, while the frusto-conical periphery 17*b* is a holding portion which cooperates with the holding portion 7*b* of the lower roll 7 to hold the sheet metal S being bent. Of course, the angle formed by the bending portion 17*a* and the holding portion 17*b* of the upper roll 17 is equal to the angle formed by the bending portion 7*a* and the holding portion 7*b* of the lower roll 7.

It is to be noted that the upper roll 17 is so designed that the circular line formed by the two frusto-conical peripheries 17*a* and 17*b* will align or coincide with a plane bisecting the angle formed by the bending portion 7*a* and the holding portion 7*b* of the lower roll 7 at the uppermost rotational position thereof. Accordingly, in the forming unit shown in the drawings, the upper roll 17 is disposed at a 45° angle to the uppermost peripheral surface of the holding portion 7*b* of the lower roll 7, since the bending portion 7*a* and the holding portion 7*b* of the lower roll 7 intersect with each other at a right angle to perform 90° bends.

As will be detailedly described hereinafter, the upper roll 17 is pivotally adjusted with regard to the lower roll 7 depending upon the thickness of the sheet metals to be processed by rotating the swing member 9 around the shaft 11. Accordingly, the upper roll 17 is so designed as to be fit for a medium between the thickest sheet metal to be processed and the thinnest one. In other words, the upper roll 17 is designed to take the best angular position with regard to the lower roll 7 when adapted for the medium thickness of the sheet metals to be processed.

As a matter of importance, the swing member 9 of the upper roll 17 is so constructed that the axis of the shaft 11 is horizontally located on a plane which runs through the lowermost point of the circular line formed by the two frusto-conical peripheries 17*a* and 17*b* of the upper roll 17 and at right angles with the plane bisecting the angle formed by the bending portion 7*a* and the holding portion 7*b* of the lower roll 7 at their uppermost rotational position. In other words, the axis of the shaft 11 is located on the plane which extends through the lowermost point of the largest diameter of the upper roll 17 at right angles to the plane of the circular line formed by the two frusto-conical peripheries 17*a* and 17*b* of the upper roll 17 located at the best angular position for the medium thickness of the sheet metals to be processed. Thus, it will be understood that the upper roll 17 will be adjustably swung around the axis of the shaft 11 for a given thickness of the sheet metal substantially along the plane bisecting the angle formed by the uppermost bending and holding portions 7*a* and 7*b* of the lower roll 7. Accordingly, the clearance between the bending portions 17*a* and 7*a* of the upper and lower rolls 17 and 7 is always substantially equal to that between the holding portions 17*b* and 7*b*.

A horizontal shaft 19 is rotatably spanned between the side walls 3*a* and 3*b* of the frame 3 by means of bearings 21, and 21 through openings 28 and 28 formed on the arms 9*a* and 9*b* of the swing member 9. The shaft 19 has a handwheel 23 secured thereto and is formed at its central portion with a screw 25 which is threaded with a wedge member 27 having at its lower end a tapered portion 29. In this construction, the wedge member 27 can be horizontally moved in either direction by the screw 25. The top of the wedge member 27 slidably abuts the underside of a horizontal beam 30 fixedly spanned between the side walls 3*a* and 3*b* through the openings 28 and 28, while the tapered portion 29 of the wedge member 27 slidably rides on a tapered member 31 which is fixedly secured by bolts 33 and 33 on a horizontal beam 35 spanned between the arms 9*a* and 9*b* of the swing member 9. Also, a spring 36 is provided between the upper beam 9*c* of the swing member 9 and the horizontal beam 30 spanned between the side walls 3*a* and 3*b* of the frame 3 so as to bias the swing member 9 upwardly. Thus, the swing member 9 can be swung up and down around the shaft 11 by rotating the handwheel 23 to horizontally move the wedge member 27. In this manner, the upper roll 17 can be raised or lowered depending upon the thicknesses of sheet metals to be processed.

A worm 39 which is connected with a motor (not shown) is horizontally provided and engages with a worm wheel 41 which is secured to the shaft 1 of the lower roll 7. Thus, when the lower roll 7 is driven by the worm 39 and the worm wheel 41, the sheet metal S is fed between the upper roll 17 and the lower roll 7 and the edge of the sheet metal is bent by the upper and lower rolls 17 and 7.

As initially described, a forming unit of the same construction as that shown in the drawings is symmetrically mounted in a manner such that for instance two hinge shaft as designated by 11 are parallel with each other, and a plurality of forming unit stations comprising such pairs of forming units are so mounted as to form two rows of symmetrically faced forming units. In such a construction, the angles which the bending portions 17*a* and 7*b* of the upper and lower rolls 17 and 7 make with the holding portions 17*b* and 7*b* in each forming unit are made gradually acuter stage by stage. Thus, when the sheet metal S is fed between the upper and lower rolls, 17 and 7, the opposite edges of the sheet metal S are bent stage by stage until they are bent to perpendicular positions with respect to the plane of the sheet metal S.

In the above described construction of the forming machine according to the present invention, the clearance between the upper and lower rolls 17 and 7 can be easily adjusted depending upon the thickness of the sheet metal S to be worked only by rotating the handwheel 23.

Also, since the shaft 13 of the upper roll 17 is mounted on the outer side of the upper roll 17 at an angle to the axis of the lower roll 7, the edges of the sheet metal S can be largely bent without hindrance of the roll shaft 13, and also edges previously bent to perpendicular positions with respect to the sheet metal plane can be further bent at right angles as shown in FIG. 2. Such double bands can be easily formed by bringing the opposite forming units nearer to each other.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. A roll forming machine for forming sheet metal of a given range of thickness comprising a plurality of forming units disposed sequentially along a work path and adapted to form said sheet metal into a given shape in a series of progressive deformations, each of said forming units including a frame rotatably supporting a lower roller about a first axis of rotation, said lower roller including working surfaces provided by a bending portion and a holding portion defining a predetermined angle therebetween, an upper roller having two frusto-conical peripheries divided by a transverse median plane and disposed in confronting relation to the working surfaces of said bending and holding portions of said lower roller and spaced therefrom by a distance corresponding substantially to a given thickness of said sheet metal, said frusto-conical peripheries defining an angle therebetween corresponding substantially to said predetermined angle, swingable means for mounting said upper roller in said frame such that when said upper roller is in confronting relation to said lower roller its axis of rotation is inclined to said first axis, and means for moving said swingable means to swing said upper roller along an arcuate path having a tangent which substantially bisects said predetermined angle in order to vary the distance between said upper and lower rollers and thereby accommodate sheet metal of different thicknesses within said range.

2. A roll forming machine as defined in claim 1, wherein said predetermined angle progressively decreases in each succissive forming unit along said work path.

3. A roll forming machine as defined in claim 1, wherein each of said forming units includes two pairs of said upper and lower rollers disposed on opposite sides of the sheet metal.

4. A roll forming machine as defined in claim 1, wherein said holding portion is a cylindrical roller of given diameter having a horizontal axis of rotation, said bending portion is a circular flange arranged coaxially with and abutting said cylindrical roller and having a diameter greater than said given diameter, and wherein said flange has a frusto-conical periphery which describes said predetermined angle in conjunction with the periphery of said cylindrical roller.

5. A roll forming machine as defined in claim 1, further including motor means for directly driving said lower roller, said upper roller being an idler roller driven by frictional engagement with the sheet metal.

6. A roll forming machine as defined in claim 1, wherein said swingable means is swingable about an axis extending parallel to said work path and said transverse median plane of said upper roller is disposed substantially parallel to the axis of said swingable means and substantially bisects said predetermined angle defined by the working surfaces of said lower roller whereby said upper roller may be moved toward and away from said lower roller along a relatively short arc which approximates a linear path contained in said plane.

7. A roll forming machine as defined in claim 6, wherein the frusto-conical peripheries of said upper roller are parallel to the respective confronting working surfaces of said lower roller only when said upper roller is positioned to engage sheet metal having a thickness at the midpoint of said range, said angle being bisected by said transverse median plane when said upper roller is at said midpoint.

* * * * *